US007736086B2

(12) United States Patent
Coomber et al.

(10) Patent No.: US 7,736,086 B2
(45) Date of Patent: Jun. 15, 2010

(54) VEHICLE ARRESTING DEVICE

(75) Inventors: Christopher Drew Coomber, Farnborough (GB); Philip John Dandy, Farnborough (GB); Brett Robert Lowery, Farnborough (GB); Christopher James Lyddon, Farnborough (GB)

(73) Assignee: Qinetiq Limited, London (GB)

( * ) Notice: Subject to any disclaimer, the term of this patent is extended or adjusted under 35 U.S.C. 154(b) by 0 days.

(21) Appl. No.: 12/269,678

(22) Filed: Nov. 12, 2008

(65) Prior Publication Data

US 2009/0317185 A1 Dec. 24, 2009

(30) Foreign Application Priority Data

Jun. 20, 2008 (GB) ..... 0811340.9

(51) Int. Cl.
*E01F 13/00* (2006.01)
*E01F 15/00* (2006.01)
*E01F 9/00* (2006.01)

(52) U.S. Cl. ..... 404/6; 404/9

(58) Field of Classification Search ..... 404/6, 404/9

See application file for complete search history.

(56) References Cited

U.S. PATENT DOCUMENTS 6,048,128 A * 4/2000 Jones et al. ..... 404/6
6,206,608 B1 * 3/2001 Blevins ..... 404/6
6,220,781 B1 4/2001 Miller
6,312,188 B1 11/2001 Ousterhout et al.
6,322,285 B1 11/2001 Ben
6,409,420 B1 6/2002 Horton et al.
2005/0089369 A1 * 4/2005 Crowley, Sr. ..... 404/6
2005/0265781 A1 * 12/2005 Blair et al. ..... 404/6
2006/0140715 A1 6/2006 Lyddon et al.

FOREIGN PATENT DOCUMENTS

CA 2 393 380 12/2002
JP A 11-36249 2/1999
WO WO 2008/026202 A2 3/2008

* cited by examiner

*Primary Examiner*—Thomas B Will
*Assistant Examiner*—Abigail A Risic
(74) *Attorney, Agent, or Firm*—Oliff & Berridge, PLC

(57) ABSTRACT

A vehicle arresting device comprises a net intended to be laid flat on the ground in the path of a target vehicle with an array of upwardly-directed spikes attached to the net along a leading portion, so that when a vehicle runs over the device some of the spikes engage in its front tires and the net is caused to wrap around the front wheels, being pulled tight under the vehicle to prevent further rotation of those wheels. There are two rows of spikes, with the spikes in the second row being substantially longer than the spikes in the leading row. The gauge of the netting also varies, with the leading strip which includes the shorter spikes and back towards the longer spikes being of a thinner gauge, the portion from the longer spikes back to approximately the mid length of the net being of a thicker gauge, and the trailing portion reverting to the thinner gauge. These measures help to ensure that the net is capable of arresting a wide range of vehicles, from passenger cars to trucks.

13 Claims, 4 Drawing Sheets

VEHICLE ARRESTING DEVICE

FIELD OF THE INVENTION

The present invention relates to vehicle arresting devices such as may be used by law enforcement agencies or military forces to safely stop the progress of a target vehicle, for example if stolen or suspected to be engaged in criminal or hostile activity.

BACKGROUND OF THE INVENTION

The invention is more particularly concerned with vehicle arresting devices of a kind comprising a flexible substrate intended to lie flat upon the ground when deployed with an array of upwardly-directed spikes attached to the substrate along a leading portion thereof (in the sense of the intended direction of approach of a vehicle to be arrested). The substrate in a device of this kind may be, for example, a panel of silk or other woven material, or it may be in the form of a net. One form of the latter kind of device is known from US Patent Application Publication no. 2006-0140715, the contents of which are incorporated herein by reference. The modus operandi of a successful arrest with a device of that kind is as follows. When a vehicle runs over the device the run-over spikes engage in its front tires and the net is caused to wrap around the front wheels, the portion of the net between those wheels being pulled tight under the vehicle so that the tension in the net prevents further rotation of the wheels and the vehicle is brought to a stop. In practice this occurs in a similar distance to an emergency stop as if the vehicle's brakes had been applied, and has the advantage that it can stop the vehicle without causing serious damage to the vehicle or injury to its occupants.

Devices of this kind have been tested in different grades aimed at the arrest of different classes of target vehicle but each have limitations for the arrest of a wider range of vehicles. For example a device made with a spike length and netting grade sufficient for the successful arrest of smaller, lighter vehicles such as passenger cars may be unable to arrest larger, heavier vehicles such as trucks for which longer, heavier spikes are required in order to achieve sufficient retention in the tires and a heavier grade of netting is required for sufficient strength to absorb the higher levels of kinetic energy involved in stopping a truck. More surprisingly, a device made with a spike length and netting grade sufficient for the successful arrest of the larger, heavier class of vehicle may not also be suited to the arrest of the smaller, lighter class of vehicle. In this respect, account must be taken of the relationship between tire diameter and spike length in order to achieve penetration when the tires encounter the spikes. For vehicles with small diameter tires, it may occur that long spikes are simply knocked over by the tires which have insufficient circumferential "reach" to roll onto the tips of the spikes. Furthermore, where spike penetration does initially take place, it may occur that the spikes are pulled out again if there is insufficient tire thickness and internal tire braiding to retain the heavier spikes against their inertia and the high centrifugal forces which are generated as they turn with the tires. This problem may also be exacerbated by the inertia of the heavier netting as the leading edge is picked up and the tire accelerates the net.

It is therefore an object of the present invention to provide a vehicle arresting device of the general kind indicated above but which is more suited to arresting a wider range of vehicle types than heretofore.

SUMMARY OF THE INVENTION

With this object in view, the device of the present invention has at least two transverse rows of spikes, including a row of shorter spikes in a leading position (in the sense of the intended direction of approach of a vehicle to be arrested) followed by a row of longer spikes. The shorter spikes can be optimised for engagement with and retention in the tires of smaller, lighter vehicles while the longer spikes can be optimised for engagement with and retention in the tires of larger, heavier vehicles, thereby enhancing the capability of the device to successfully arrest a wide range of vehicle types.

At the same time, the grade of the netting or other substrate preferably varies in the fore and aft direction of the device, comprising a portion of lighter grade at the extreme leading edge of the device and extending somewhat beyond the row of shorter spikes to facilitate initial pick-up of the substrate by all applicable vehicle types, followed by a portion of heavier grade where the longer spikes are fitted and extending rearwardly therefrom, the latter of sufficient strength to arrest both lighter and heavier vehicles. This heavier grade portion may itself be followed by a trailing portion which reverts to the lighter grade of netting or other substrate. In this respect, it has been found from analysis of the stress distribution pattern within a net when making an arrest with this type of device that the highest loads tend to occur in the portion immediately following the array of spikes which accordingly needs to be of the highest tensile strength. To economize on the cost of the substrate and overall weight of the device for manual handling, it is therefore possible to utilise a trailing portion of lesser tensile strength without detriment to the performance of the device.

Preferably a series of longitudinal slits are provided in the leading portion of the net or other substrate, so that only the respective section of substrate between the adjacent slits has to be lifted by the tire during its initial rotation after engaging the spikes, thereby further assuring spike retention in the tire. These preferably extend into the above-described portion of highest tensile strength following the spikes which is best able to resist the stress concentrations at the ends of the slits.

BRIEF DESCRIPTION OF THE DRAWINGS

These and other objects and features of the invention will now be more particularly described, by way of example, with reference to the accompanying drawings in which.

DETAILED DESCRIPTION OF THE PREFERRED EMBODIMENT

Figure 1:
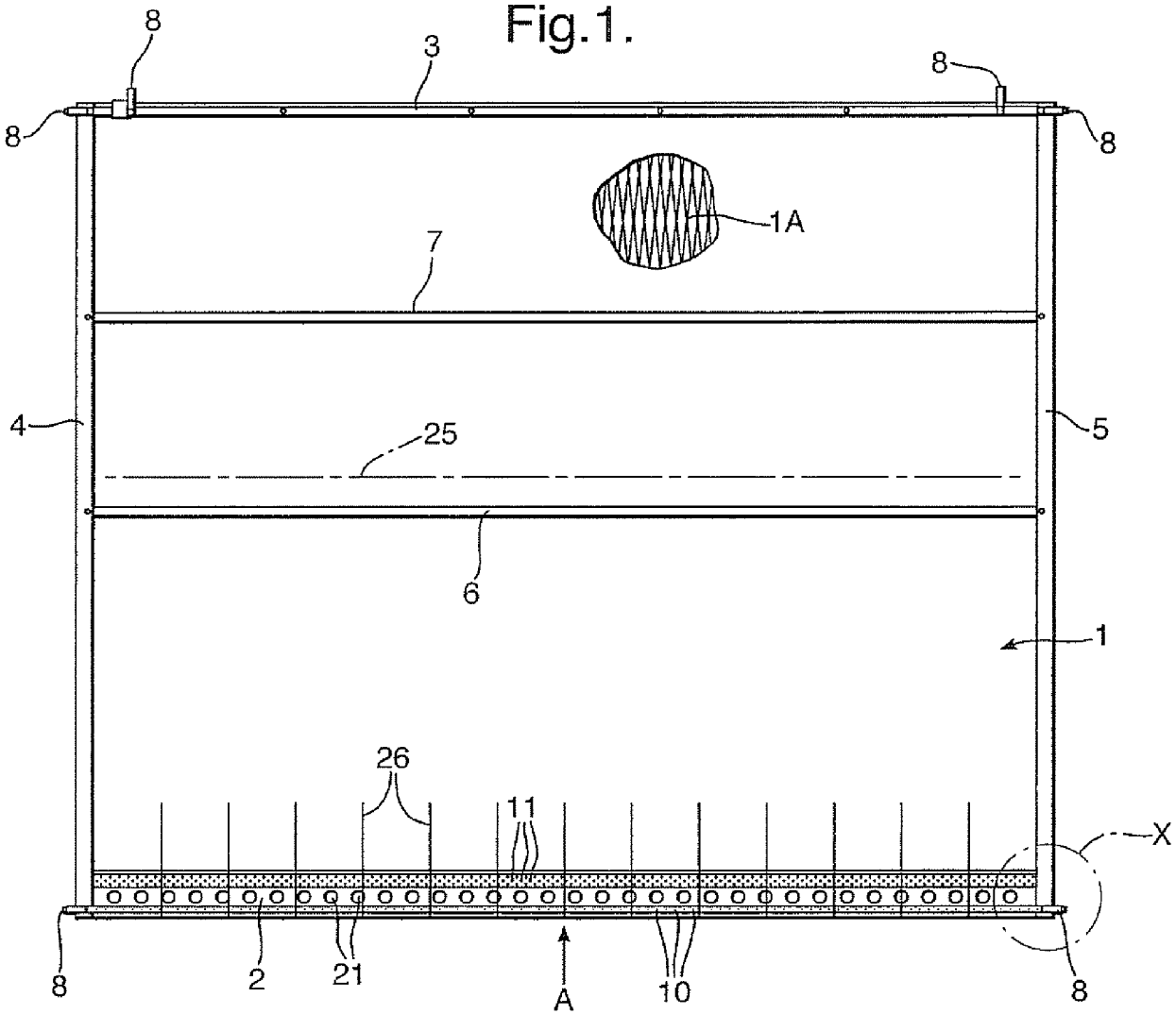
FIG. 1 is a simplified plan view of a preferred form of vehicle arresting device according to the invention in its deployed configuration.

With reference to FIG. 1 there is shown a plan view of a vehicle arresting device in accordance with the invention in its deployed configuration, that is to say, laid flat upon the ground with the intention of arresting a vehicle (not shown) approaching in the direction of arrow A. It comprises a net 1 of rectangular planform, the mesh of which is illustrated only schematically for a patch at 1A in FIG. 1 but the geometry and scale of which is depicted more accurately, but still somewhat schematically, in FIG. 2. The net 1 is woven from high breaking strain braided polyethylene fibre, such as that marketed by Royal DSM N.V. under the registered trade mark "Dyneema". In the illustrated condition the overall shape of the net is maintained by strips of light nylon or similar webbing 2, 3, 4, 5, 6 and 7 attached respectively at its leading and trailing edges (in the sense of its orientation to the oncoming vehicle), side edges and transversely at two intermediate locations. Tapes 8 are also attached to the strips 3, 4 and 5 at the trailing and side edges in order to facilitate the manual folding and deployment if the assembled device.

Figure 2:
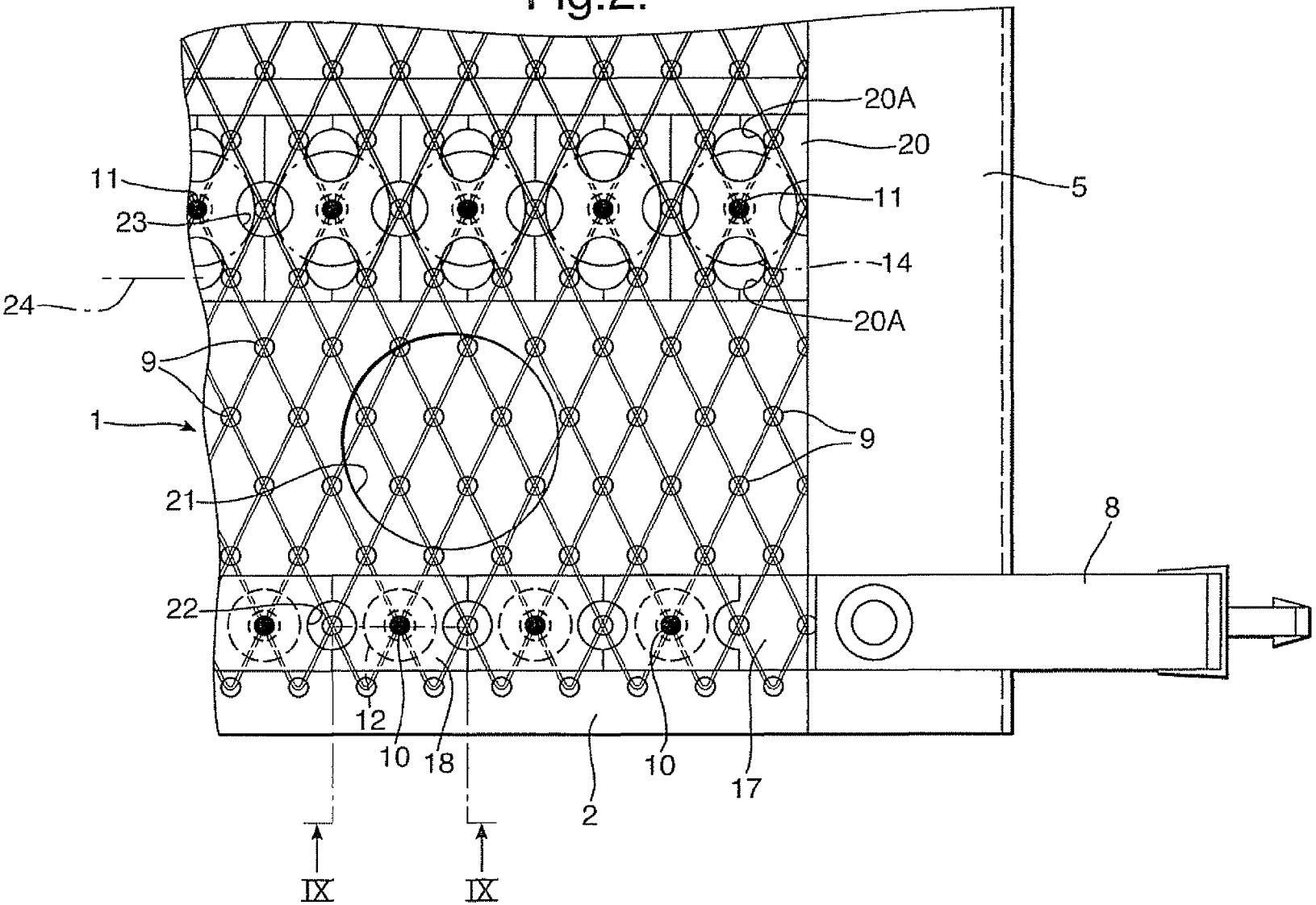
FIG. 2 is a view to an enlarged scale of the region of the device indicated at 'X' in FIG. 1.

As shown in FIG. 2, the loops of the net 1 are in a diamond shape with the longer dimension of the diamond in the fore and aft direction and a knot 9 at each vertex. The "natural" form of the loops in which the net is originally woven is actually rectangular with the longer dimension of the rectangle in the transverse direction, but in the course of assembly the net is pulled into the illustrated loop orientation in which it is retained by the attachment of the strips 2 to 7, all as described in US2006-0140715.

At the leading edge region of the net 1 there are two transverse rows of upwardly-directed hardened steel spikes 10 and 11, with the spikes 11 in the second row being substantially longer than the spikes 10 in the first (leading) row. As shown in FIG. 2, in each row there is a spike 10 or 11 located at each alternate knot 9 across the width of the net 1, with the two rows laterally offset from each other by one knot. The form of the spikes is more particularly shown in FIGS. 3 to 8.

Figure 3:
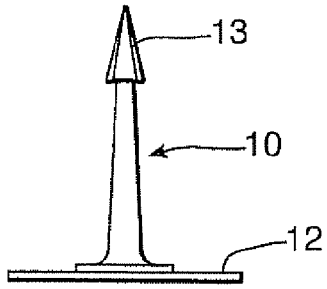
FIGS. 3 and 4 are respectively a side elevation and a plan view of a shorter spike assembly incorporated in the device of FIGS. 1 and 2, to an enlarged scale.
Figure 4:
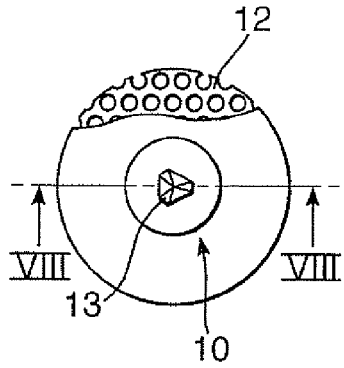
Figure 5:
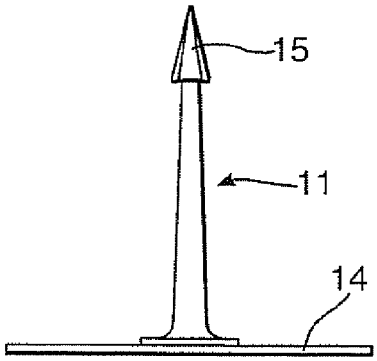
FIGS. 5 and 6 are respectively a side elevation and a plan view of a longer spike assembly incorporated in the device of FIGS. 1 and 2, to the same scale as FIGS. 3 and 4.
Figure 6:
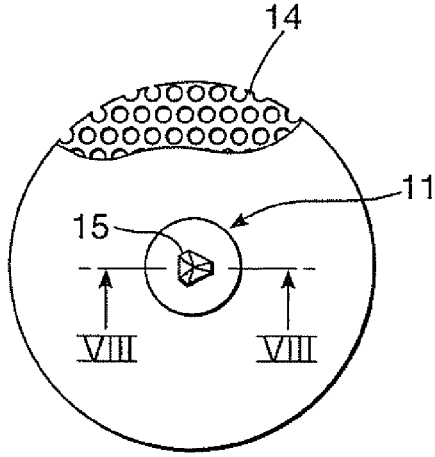
Figure 7:
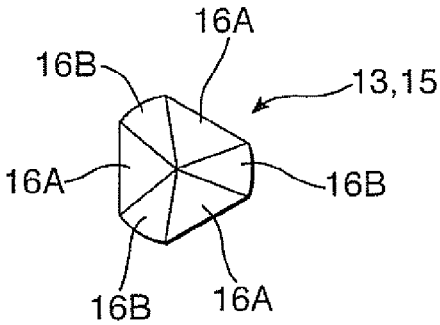
FIG. 7 is plan view of the barb at the tip of the spikes of FIGS. 3 to 6, to an enlarged scale.
Figure 8:
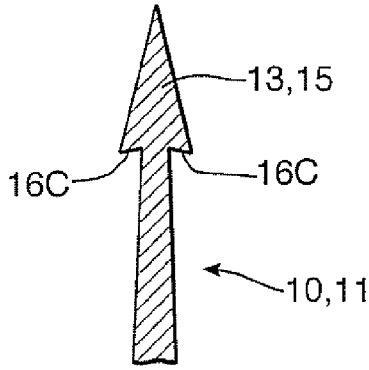
FIG. 8 is a scrap section on the line VIII-VIII of FIGS. 4 and 6.

With reference to FIGS. 3 and 4, each spike 10 is part of an assembly comprising also a circular base 12 welded to the respective spike, and is tipped with a sharply pointed, generally pyramidal barb 13. The base 12 helps to ensure that the spike is deployed upright when the device is laid on the ground, and is perforated as shown for a portion thereof in FIG. 4 to minimise the weight of the assembly. With reference to FIGS. 5 and 6, each spike 11 is part of an assembly of the same general form as the spikes 10, with a base 14 and barb 15, the essential difference being that the shaft of the spike is longer and the base is wider than for the spikes 10. By way of example, the spikes 10 may extend to a height of 43 mm and the spikes 11 to a height of 55 mm from the respective base. With reference to FIG. 7, the barbs 13,15 are polygonal in planform, being machined from a solid cone to provide three major flat faces 16A between three minor frustoconical faces 16B with a common vertex, and are undercut at the base of the barb as indicated at 16C in FIG. 8.

Figure 9:
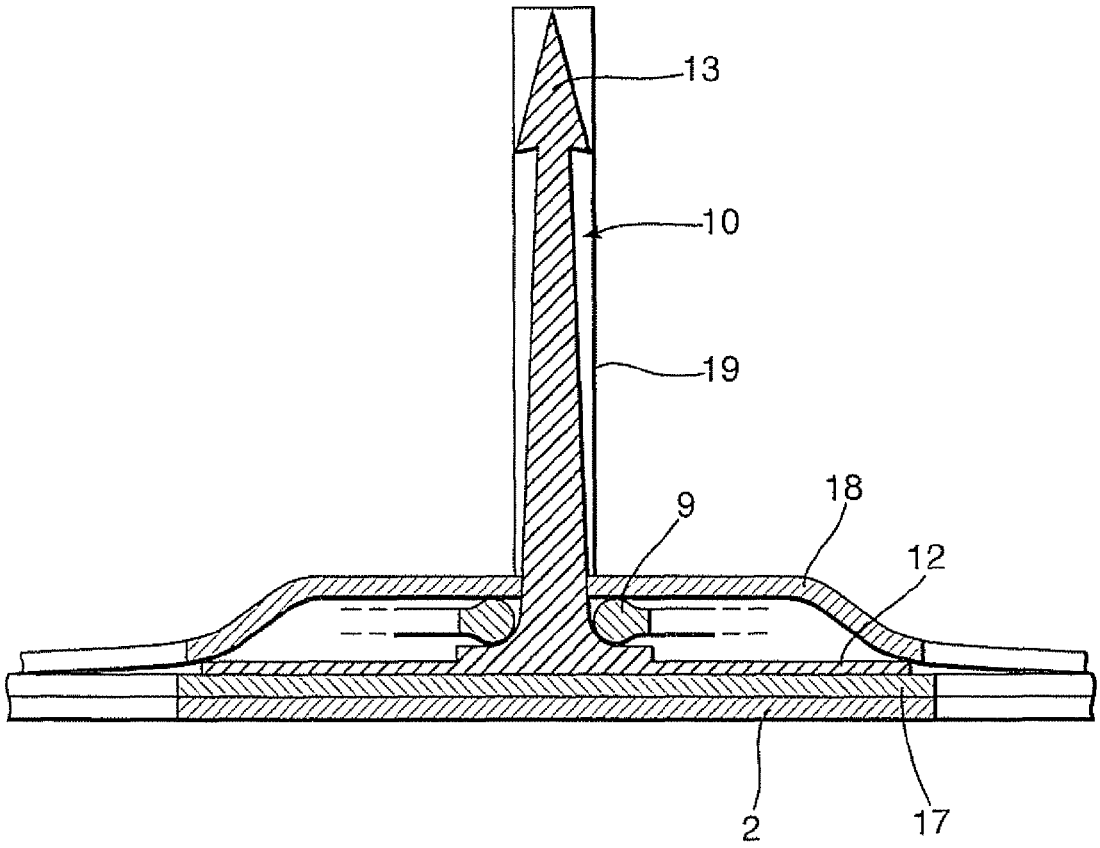
FIG. 9 is a section on the line IX-IX of FIG. 2, to an enlarged scale.

The attachment of the shorter spikes 10 to the net 1 and to the leading edge webbing strip 2 in the first row will now be described with reference to FIGS. 2 and 9. The spikes 10 are assembled with the net 1 by thrusting the barbs 13 of each spike through the respective knot 9 of the net and passing the knot down to engage frictionally around its shaft, as shown in FIG. 9. The spikes 10 are then held on the strip 2 at the correct spacing by multiple hook and loop contact fastener material such as that known under the registered trademark "Velcro". A length of Velcro® hook material 17 is sewn to the leading edge strip 2 where the row of spikes is required and the spike assemblies are attached by respective pads of Velcro® loop material 18 passing over the respective net knots 9 and spike bases 12 into contact with the hook material 17, the pads 18 being apertured to pass the spike shafts and barbs, and the net 1 passing out between the edges of the Velcro® material in the fore and aft direction as indicated in FIG. 2. A plastics tube 19 (FIG. 9) is passed over the exposed length of each spike 10 to prevent injury to operators handling the device and to prevent the barbs 13 snagging on the net when it is folded for storage and transportation.

The attachment of the longer spikes 11 to the net 1 and to the leading edge webbing strip 2 in the second row is achieved in a similar manner to the first row spikes. FIG. 2 shows respective pads of Velcro® loop material 20 passing over the respective net knots and spike bases 14 into contact with a length of Velcro® hook material (not shown) which will be sewn to the strip 2 where the second row of spikes is required, these pads being apertured to pass the spike shafts and barbs and also apertured as indicated at 20A to pass the net 1 in the fore and aft direction. The spikes 11 will also be surrounded by plastics tubes of appropriate length similar to the tubes 19 for spikes 10.

Holes 21-23 are pre-cut through the material of the strip 2 and (in the case of holes 22 and 23) through the associated Velcro® material to reduce both the weight of the overall assembly and any aerodynamic forces due to wind acting on the leading edge of the device when deployed.

The gauge (i.e. thickness) of the braid from which the net 1 is woven varies at different regions of the net (although the loop size is maintained substantially constant). That is to say, at the leading edge of the device where the first row of (shorter) spikes 10 is attached, and rearwardly to the row of knots 9 at the line 24 in FIG. 2, the net is woven from a first, thinner gauge of braid, say 3 mm diameter. Rearwardly from that position—that is to say including where the second row of (longer) spikes 11 is attached—and up to the line indicated at 25 in FIG. 1, the net is woven from a second, thicker gauge of braid, say 4 mm diameter. Finally, from the position 25 to the trailing edge of the device the net reverts to the first, thinner gauge of braid. Also, the leading portion of the net 1 (but not the webbing strip 2) is formed with a series of longitudinal slits 26 spaced across its width, as schematically depicted in FIG. 1, these extending rearwardly past the rows of spikes 10 and 11 and well into the region of thicker gauge netting.

The illustrated device is designed to be portable and is normally kept packed in a folded condition, but can rapidly be unfolded and deployed across a roadway when a target vehicle is to be arrested, either manually or by means of a winch-based deployment system such as described in co-pending United Kingdom Patent Application no. 0810021.6.

In use, when a vehicle encounters the deployed device from the direction of arrow A in FIG. 1, its front tires will first run over a number of adjacent spikes 10 in the leading row. As a respective spike is encountered the surrounding tube 19 is crushed down by the tire, allowing the spike to penetrate the tire. The barb 13 is shaped to facilitate entry of the spike into the tire and its undercut 16C is designed to catch on the conventional steel braiding within a tire carcass. The net 1 therefore becomes attached to the front wheels of the vehicle at two locations across its width, being trapped between the bases 12 of the respective spike assemblies and the tires in which the spikes are embedded. This will normally be the case irrespective of the class of vehicle involved since the spikes 10 are short enough to avoid knock-over even by small diameter tires.

Shortly thereafter the front tires will also encounter the longer spikes 11 in the second row. In the case of a larger class of vehicle such as a truck, full penetration of the tires will be achieved by a number of adjacent spikes 11 and the retentive force of these spikes in the tires should be sufficient to prevent the spikes from being pulled out again under the loads applied through the net as the arrest proceeds even if this would not be the case for two rows of shorter spikes such as 10. In the case of a smaller class of vehicle such as a passenger car, penetration of the tires by the longer spikes 11 may or may not be achieved, depending on the particular tire diameter of the vehicle, but in a case where the tires are so small as to knock over the spikes 11 they should be sufficiently well matched to the shorter spikes 10 and the vehicle should be sufficiently light as to maintain sufficient spike retention for an arrest by means of the first row alone. Furthermore, since there is a relatively light gauge of netting 1 in the portion from the first row of spikes up to the second row, the inertial forces applied to the spikes 10 as they begin to pick up the net are lower than for a net with the heavier gauge throughout and should allow the net to wrap partially around the tires, thus itself increasing the resistance to spike pull-out, before the higher inertia of the second spike row and heavier gauge netting is encountered.

In any case, therefore, continued movement of the vehicle should cause the net 1 to wrap around the front wheels of the vehicle and the portion of the net between the wheels to be pulled tight under the vehicle and around suspension components until its tension prevents further rotation of those wheels, thereby bringing the vehicle to a stop. The region of the net which is subject to the highest loads during this process is generally that which follows the second spike row and up to approximately the mid length of the net, namely the region of thicker gauge braid up to the line 25 in the illustrated embodiment. A useful saving in the overall cost and weight of the device can therefore be achieved by the transition back to the light gauge braid in the trailing portion of the net 1, without compromising the performance of the device.

Furthermore, by virtue of the slits 26 through the leading portion of the net 1, only the respective section of the net between the adjacent slits has to be lifted by the tire during the initial part of its rotation after engaging the spikes, which further minimises the risk of spikes being pulled from the tire. In this respect the respective section of net will pull off from the webbing strip 2 by separating the relevant sections of Velcro® material which hold the spikes to that strip, under the initial impetus imparted to the net after spike engagement with the tires. As previously noted, the slits 26 extend into the stronger, thicker braided portion of the net (between the lines 24 and 25) which is best able to absorb the slit ("crack") energy at the ends of the slits and avoids the risk of ripping the thinner gauge netting at the leading edge.

The ability of the net 1 to stretch laterally in the course of an arrest, and the absence of constraint in this sense applied by the lateral strips 2, 3, 6 and 7, all as described in US2006-0140715, also applies to the embodiment described herein.

The invention claimed is:

1. A vehicle arresting device comprising a flexible substrate adapted to be laid on the ground in an approach path of a vehicle to be arrested with at least two transverse rows of upwardly-directed spikes attached to the substrate at a leading portion thereof such that when the front tires of a vehicle run over said leading portion one or more said spikes become embedded in each said tire, thereby attaching the substrate to each front wheel of the vehicle, the substrate becomes wrapped around the front wheels of the vehicle and the portion thereof between those wheels of the vehicle is pulled tight under the vehicle, thereby preventing further rotation of those wheels, the spikes in a following said row being longer than the spikes in the leading said row, and a first transverse portion of the substrate, to which said leading row of spikes is attached and which extends rearwardly thereof towards said following row of spikes, is of a first grade of material, and a second transverse portion of the substrate, to which said following row of spikes is attached and which extends rearwardly thereof at least for some distance, is of a second grade of material heavier than said first grade.

2. A device according to claim 1 wherein said substrate is in the form of a net, and said second transverse portion thereof is of the same material as and of a gauge thicker than said first transverse portion.

3. A device according to claim 1 wherein a third transverse portion of the substrate, which extends rearwardly of said second transverse portion, is of a grade of material lighter than said second grade.

4. A device according to claim 3 wherein said substrate is in the form of a net, said third transverse portion thereof being of the same material as and of a gauge thinner than said second transverse portion.

5. A device according to claim 3 wherein said third transverse portion of the substrate extends to the trailing edge thereof.

6. A device according to claim 1 wherein a series of longitudual slits are provided in the substrate extending from its leading edge into said second transverse portion thereof.

7. A vehicle arresting device comprising a substrate adapted to be laid on the ground in an approach path of a vehicle to be arrested with an array of upwardly-directed spikes attached to the substrate at a leading portion thereof such that when the front tires of a vehicle run over said leading portion one or more said spikes become embedded in each said tire, thereby attaching the substrate to each front wheel of the vehicle, the substrate becomes wrapped around the front wheels of the vehicle and the portion thereof between those wheels is pulled tight under the vehicle, thereby preventing further rotation of those wheels, the leading edge of the substrate being of a lighter grade of material than a transverse portion of the substrate which extends rearwardly of the array of spikes, the spikes being in at least two transverse rows with the spikes in a following said row being longer than the spikes in the leading said row.

8. A device according to claim 7 wherein said substrate is in the form of a net, said leading edge thereof being of the same material as and of a gauge thinner than said transverse portion thereof which extends rearwardly of the array of spikes.

9. A vehicle arresting device comprising a substrate adapted to be laid on the ground in an approach path of a vehicle to be arrested with an array of upwardly-directed spikes attached to the substrate at a leading portion thereof such that when the front tires of a vehicle run over said leading portion one or more said spikes become embedded in each said tire, thereby attaching the substrate to each front wheel of the vehicle, the substrate becomes wrapped around the front wheels of the vehicle and the portion thereof between those wheels is pulled tight under the vehicle, thereby preventing further rotation of those wheels, a transverse portion of the substrate which extends rearwardly of the array of spikes being of a first tensile strength and a transverse portion of the substrate which extends rearwardly of said portion of first tensile strength being of a second tensile strength lower than said first tensile strength, the spikes being in at least two transverse rows with the spikes in a following said row being longer than the spikes in the leading said row.

10. A device according to claim 9 wherein said substrate is in the form of a net, said portion of second tensile strength being of the same material as and of a gauge thinner than said portion of first tensile strength.

11. A method of arresting a vehicle which comprises laying a device according to claim 1 on the ground in the path of the vehicle such that when the front tires of the vehicle run over the leading portion of the device one or more said spikes become embedded in each said tire, thereby attaching the substrate to each front wheel of the vehicle, the substrate becomes wrapped around the front wheels of the vehicle, and the portion thereof between those wheels of the vehicle is pulled tight under the vehicle, thereby preventing further rotation of those wheels.

12. A method of arresting a vehicle which comprises laying a device according to claim 7 on the ground in the path of the vehicle such that when the front tires of the vehicle run over the leading portion of the device one or more said spikes become embedded in each said tire, thereby attaching the substrate to each front wheel of the vehicle, the substrate becomes wrapped around the front wheels of the vehicle, and the portion thereof between those wheels of the vehicle is pulled tight under the vehicle, thereby preventing further rotation of those wheels.

13. A method of arresting a vehicle which comprises laying a device according to claim 9 on the ground in the path of the vehicle such that when the front tires of the vehicle run over the leading portion of the device one or more said spikes become embedded in each side tire, thereby attaching the substrate to each front wheel of the vehicle the substrate becomes wrapped around the front wheels of the vehicle, and the portion thereof between those wheels of the vehicle is pulled tight under the vehicle, thereby preventing further rotation of those wheels.

* * * * *